United States Patent [19]

Read

[11] 4,084,365

[45] Apr. 18, 1978

[54] ONE-PIECE ROOFING TILE

[76] Inventor: John Cecil Read, 1252 La Jolla Rancho Rd., La Jolla, Calif. 92037

[21] Appl. No.: 769,896

[22] Filed: Feb. 18, 1977

[51] Int. Cl.[2] ..... E04D 1/00

[52] U.S. Cl. ..... 52/529; 52/545

[58] Field of Search ..... 52/529, 531, 534, 545

[56] References Cited

U.S. PATENT DOCUMENTS

| | | | |
|---|---|---|---|
| 487,372 | 12/1892 | Montross | 52/529 |
| 588,161 | 8/1897 | Montross | 52/529 |
| 3,603,057 | 3/1969 | Curran | 52/531 |

FOREIGN PATENT DOCUMENTS

| | | | |
|---|---|---|---|
| 216,561 | 5/1967 | Sweden | 52/545 |

*Primary Examiner*—James L. Ridgill, Jr.
*Attorney, Agent, or Firm*—Brown & Martin

[57] ABSTRACT

A roofing tile of the simulated Spanish or mission type comprises a thin sheet of material formed to define a double convoluted panel having an upslope end with an upturned locking flange and groove at the upslope end and a downturned locking groove and flange at the down slope end, and locking lip and overhang on opposite side edges of the roofing tile.

6 Claims, 4 Drawing Figures

FIG. 1
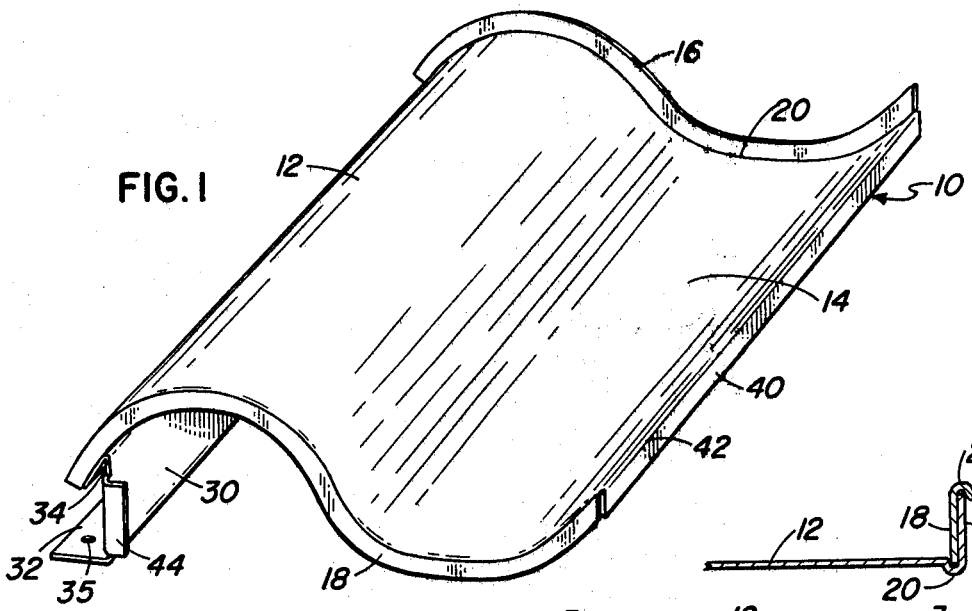
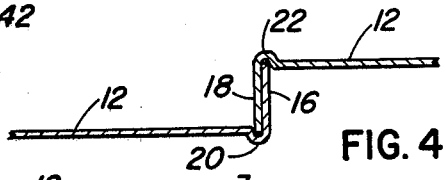
FIG. 4
FIG. 2
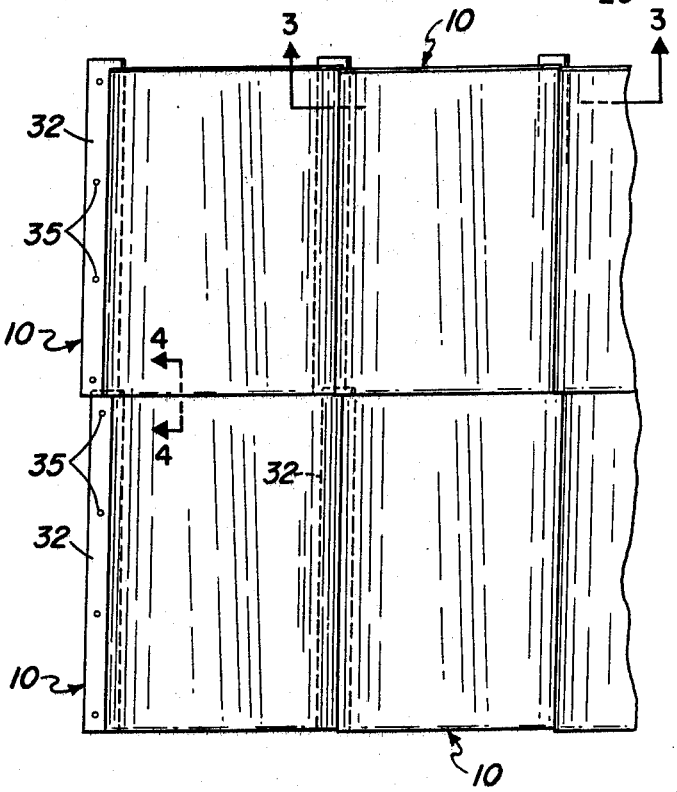
FIG. 3
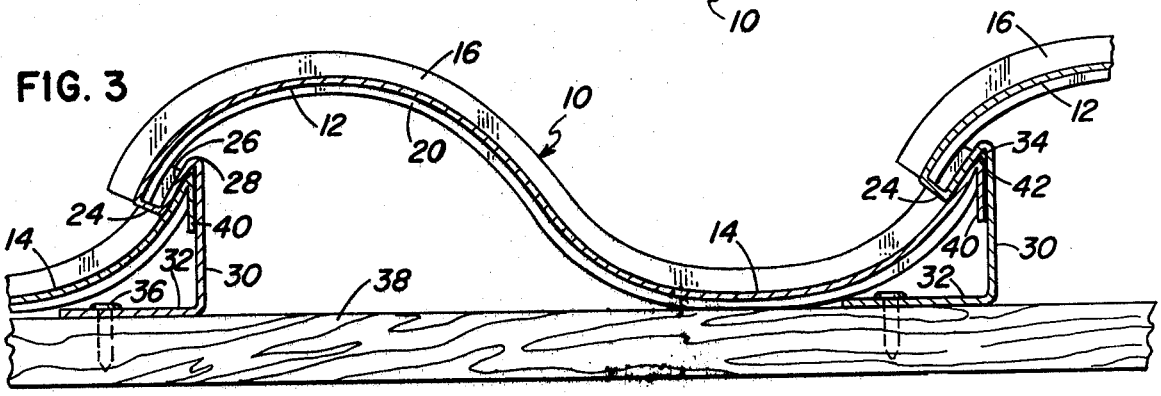

ONE-PIECE ROOFING TILE

BACKGROUND OF THE INVENTION

The present invention relates to roofing panels and pertains particularly to roofing tile of a type simulating Spanish or mission tile.

Roofing structures must be not only effective to shield the structure from the elements, it must also, in most instances, be aesthetically pleasing. Such aesthetic requirements are typically imposed by local building ordinances. Many local communities dictate architectural style in buildings. Many communities in the West and Southwest, for example, dictate a Spanish style or motif to buildings.

The Spanish style building typically employs a clay roofing type of semi-cylindrical configuration. Many attempts have been made to simulate such styles in less expensive and more effective materials over the years. These approaches have met with a limited amount of success.

Among the problems with the prior art approach is that the tile structures, while effectively simulating the desired aesthetic characteristics, failed to meet the structural desirabilities or failed to meet the economic requirements. It is desirable that such structures be not only effective but inexpensive. One problem with such prior art structures is that they require numerous and complex fittings for applying the roofing structures. Another disadvantage of such prior art devices is that they typically require a considerable amount of overlap to ensure effectiveness against rain and the like.

Accordingly it is desirable that a roofing tile be available that is both simple and inexpensive to manufacture and apply as well as being aesthetically pleasing.

SUMMARY AND OBJECTS OF THE INVENTION

Accordingly it is the primary object of the present invention to overcome the above problems of the prior art.

Another object of the present invention is to provide a roofing tile that is inexpensive, simple, and inexpensive to manufacture and is easy to apply.

A further object of the present invention is to provide a simple and inexpensive roofing tile that is effective to seal a structure against weather.

In accordance with the primary aspect of the present invention, a roofing tile is constructed of a thin sheet of material shaped to define a double convoluted panel having upslope and downslope ends with interlocking lips and grooves and lateral edges having locking channels and lips.

BRIEF DESCRIPTION OF THE DRAWING

The above and other objects and advantages of the present invention will become apparent from the following description when read in conjunction with the drawings, wherein:

FIG. 1 is a perspective view of a roofing tile in accordance with the invention.

FIG. 2 is a top plan view of a plurality of tiles shown in cooperative engagement.

FIG. 3 is a sectional view taken on lines 3—3 of FIG. 2.

FIG. 4 is a sectional view taken on lines 4—4 of FIG. 2.

DETAILED DESCRIPTION OF A PREFERRED EMBODIMENT

Turning now to the drawing, particularly FIG. 1, there is illustrated a roofing tile designated generally by the numeral 10 constructed in accordance with the preferred embodiment of the present invention. The tile comprises a sheet of suitable roofing material such as a suitable sheet metal, or sheet plastic, or any other suitable material. The tile is shaped in a generally S-shape, as viewed from the end defining a double convoluted panel having a generally convex portion 12 and a generally concave portion 14. These portions are somewhat semi-cylindrical in appearance but are slightly tapered such that the upper end of the portion 12 has a surface diameter slightly less than the surface diameter of the lower end thereof. Similarly the concave portion 14 of the panel has a diameter at the lower end that is slightly less than the diameter at the upper end.

The upper or upslope end of the panel is defined by an up turned flange 16 and the lower end or down slope end is defined by a down turned flange 18. The down turned flange 18 is designed to overlap the up turned flange 16 of a downslope panel or tile to provide an interlocking relationship as well as to provide a weather proof joint, as in FIG. 4. Preferably the radius of curvature of the upper edge of flange 18 on the 12 portion side matches the upper radius of the upper edge of the flange 16. Similarly the radius of curvature of the lower edge of flange 18 matches the radius of curvature of the lower edge or upper surface at the upper edge or flange 16. Similarly the radius of curvatures of the respective flanges on the 14 side of the panel will match. This ensures a close fitting engagement of the panels and provide an interlocking of the respective flanges and grooves.

The upper end of the panel is preferably formed with a locking groove 20 at the juncture of the flange 16 with the surface of the panel. This groove receives the lower edge of the flange 18 of the overlapping upslope tile or panel. Similarly the lower end of a tile is provided with a locking groove 22 at the juncture of the flange 18 with the undersurface of the tile. This provides a groove for receiving the upper edge of the flange 16 at the upper edge of a downslope tile.

Turning now to FIG. 3 of the drawing, the left edge of the tile or panel is constructed with a fold back or return folded edge forming an overhang portion defining a side face 24 of a generally rectangular configuration simulating the edge of a clay tile, for example. The sheet is folded back upward defining a fold back portion 26 which extends backward substantially parallel to the surface of the portion 12 and is again folded downward at a fold 28 forming a downwardly extending or vertical wall 30 with an outwardly extending foot or flange 32. The juncture of the walls 26 and 30 define normally triangular shaped groove defining a locking channel 34, into which the opposite edge of an adjacent tile fits for interlocking engagement. The foot or flange portion 32 defines a nailing flange with nail holes 35 into which nails 36 may be driven for attaching the tile to a roof substructure 38.

The right hand side of the panel includes a downwardly turned flange 40 for defining a generally rectangular edge depicting or simulating the edge of a clay tile. This downwardly turned edge forms a generally triangular shaped edge 42 for extending upward into the locking channel 34 for defining a locking edge. Thus, as best seen in FIG. 3, the edge 42 extends upward into a locking channel 34 of an adjacent tile. The overhang or overlap portion of the adjacent tile insures a generally rain proof fit of the respective adjacent tiles.

Turning now specifically to FIG. 2, there is illustrated a plurality of the panels 10 showing the interlocking relationship of a plurality of such panels in place for example on the roof of a building. The interlocking nature of the panels provide a secure roofing installation as well as a simulated tile roof. The edges 18 and 24 simulate the edges of so called Spanish or mission tile.

The flanges 16 and 18 in addition to appearance give a strength to the tile that improves the strength thereof for providing the ability to support a person on the roof. A flange 44 at the down slope end of the wall 30 adds to the strength thereof. The tile portion 14 has a somewhat flatter profile than the other side and is mounted close to the sub roof so that it can be walked on without damage to the tile.

Thus it is seen from the above description and drawings that I have provided a novel roofing tile that is simple and inexpensive to manufacture and simple and easy to install. Such roofing is similarly highly effective to secure a building against the elements such as rain or the like and is also visually aesthetic.

Having described my invention, I now claim:

1. A one piece roofing tile structure comprising:

a relatively thin sheet material shaped to define a double convoluted panel having an upslope end defined by an upturned vertically extending flange of said sheet, a downslope end spaced from the upslope end defined by a downturned flange, and generally parallel first and second side edges, one of said side edges defined by an overlapping overhang defined by a return fold of said sheet material and a vertical support wall defined by a downward fold of said sheet material defining a locking channel therebetween, and connecting flange on the foot of said wall extending outwardly at a right angle to said wall, the other of said side edges defining locking means for engaging into a locking channel of an adjacent tile.

2. The roofing tile of claim 1, cooperatively associated with at least one other roofing tile wherein said upturned flange at said upper end is overlapped by a downturned flange of said adjacent tile.

3. The roofing tile of claim 2, interlocked with at least one adjacent identical roofing tile wherein the locking means of one of said tile and the locking channel of the other of said tiles are in locking engagement.

4. The roofing tile structure of claim 1, including a groove formed in the upper surface of said panel adjacent and extending along the upturned vertically extending flange for receiving and interlocking with the lower edge of a downturned flange at the lower end of an upslope tile.

5. The roofing tile of claim 4, including a groove formed in the under surface of said panel adjacent and extending along the downturned flange for receiving and interlocking with the upper edge of an upturned vertically extending flange of a downslope tile.

6. The roofing tile of claim 4 wherein said upturned flange and said downturned flange are substantially mirror images, and the thickness defined by the overlapping and interlocking flanges of longitudinally adjacent tiles are substantially equal to twice the thickness of a tile.

* * * * *